United States Patent [19]

Brennan

[11] 4,429,932

[45] Feb. 7, 1984

[54] DESK TOP ORGANIZER

[76] Inventor: V. Jack Brennan, P.O. Box 70639, Pasadena, Calif. 91107

[21] Appl. No.: 389,273

[22] Filed: Jun. 17, 1982

[51] Int. Cl.[3] ..... A47B 43/02; A47B 63/04

[52] U.S. Cl. ..... 312/259; 229/15; 229/42; 312/297

[58] Field of Search ..... 5/DIG. 1; 312/259, 260, 312/261, 262, 210, 297; 229/42, 15; 248/152, 174; 211/73

[56] References Cited

U.S. PATENT DOCUMENTS

| | | | |
|---|---|---|---|
| Re. 26,557 | 3/1969 | Houstan | 229/15 |
| 1,930,348 | 10/1933 | Parrott | 312/297 |
| 1,984,609 | 12/1934 | Walker et al. | 229/15 |
| 2,007,697 | 7/1935 | Usher | 229/15 |
| 2,391,285 | 12/1945 | Williamson et al. | 211/73 |
| 2,578,060 | 12/1951 | Grant | 229/15 |
| 2,665,048 | 1/1954 | Belsinger | 229/15 |
| 2,989,222 | 6/1961 | Haffenreffer | 229/15 |
| 3,236,433 | 2/1966 | Barrett et al. | 229/42 |
| 4,080,023 | 3/1978 | Bair | 312/259 |

FOREIGN PATENT DOCUMENTS

| | | | |
|---|---|---|---|
| 2098987 | 10/1972 | France | 229/15 |
| 882716 | 11/1961 | United Kingdom | 229/42 |

*Primary Examiner*—William E. Lyddane
*Assistant Examiner*—Thomas A. Rendos
*Attorney, Agent, or Firm*—Erik M. Arnhem

[57] ABSTRACT

The disclosure describes an office organizer for placement on a desk, comprising a sub-assembly of folded partitions mounted paralelly, respectively perpendicularly to one another to form double walled compartments, a tray folded around the sides, top and bottom of the sub-assembly of partitions and a wrap, having a rectangular center portion and curved end sections and attachable to the sides and bottom of the tray, being so dimensioned as to provide forwardly projecting winged sides for and an extension of the bottom surface of the tray.

5 Claims, 7 Drawing Figures

DESK TOP ORGANIZER

BACKGROUND OF THE INVENTION (1) Field of the Invention

The invention relates to a roll-top type structure, placeable on a flat desk or table. Basically the structure is an imitation of the conventional solid roll-top desk, however, without the sliding cover, elevating legs and supporting flat desk surface.

The introduction of the solid roll-top desk, dates back to the 19th century, but because of its utility and nostalgia, it has become a much sought after item. In contrast to the conventional roll-top desk, the structure, according to the invention, may be shipped in a knocked-down state and rather quickly assembled for placing on the top of a desk. Furthermore, the structure is made, preferably of flexible lightweight prefabricated components, in decorative color(s), so that it will softly blend in with existing furniture.

The invention, basically serves the same purpose as the conventional roll-top desk, i.e., providing a number of horizontal and vertical pigeon compartments or holes for insertion of letters and files, drawers for storage of stationery, etc. The structure includes wings, projecting outwardly curved (which, in the original type roll-top desk holds the sliding cover) so as to give the person, e.g., a student, businessman, etc., the feeling of privacy when writing letters, etc.

The cost of manufacturing and shipping the prefabricated knocked-down unit made e.g., of corrugated fiber board is, of course far below that of the solid wooden roll-top desk.

(2) Prior Art

The inventor is not aware of any prior art that would anticipate his invention.

SUMMARY OF THE INVENTION

In addition to what was stated under (d) above, the invention refers to a light weight desk top organizer, which is made of corrugated fiber board section, however, possessing sufficient strength to carry the weight of sundry office supplies, including staplers, files, and the like. In assemblying—from a completely knocked down state—a number of partitions parallely, respectively perpendicularly to each other, one is able to construct a rigid sub-assembly containing open-ended double-walled pigeon holes, openings for drawers, etc. A supportive tray is then appropriately folded and mounted onto the back, top, bottom and side surfaces of the sub-assembly, and finally, a wrap-around section is loosely attached onto the bottom and vertical sides of the supportive partitioned tray in a manner that portions thereof are projecting forwardly and beyond the perimeter of the partitioned tray sub-assembly to form a table or writing surface and two lateral wings, which extend outwardly from the sides of the sub-assembly. In completing the desk top organizer, according to the invention, one has, thus constructed an imitation of the classical roll top desk, when placed on top of a plain table, desk, counter or supporting surface.

It is, thus the object of the invention to provide lightweight, and easy to assemble flexible components for a desk top organizer placeable on a table surface.

It is a further object of the invention to provide and create an illusion of the conventional roll top desk by way of inexpensive material.

DESCRIPTION OF THE INVENTION

Figure 1:
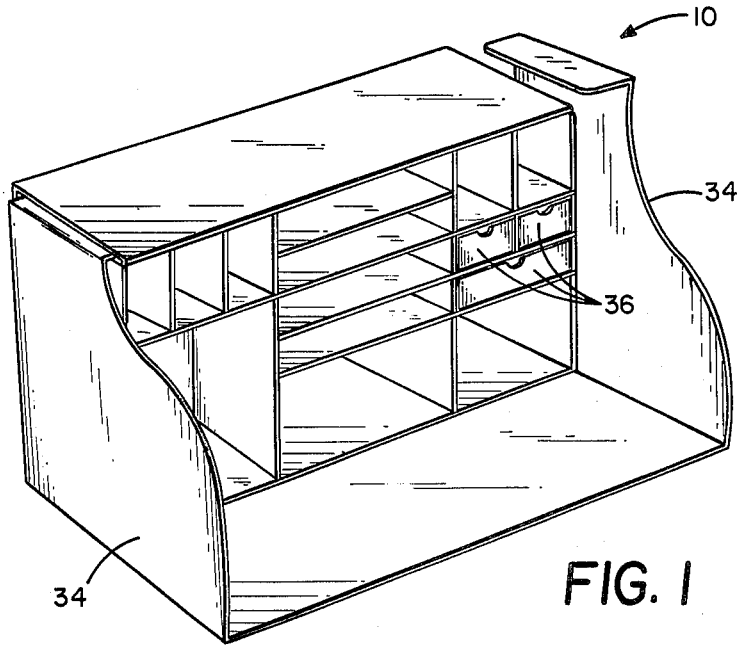
FIG. 1 is a perspective front view of a desk top organizer in its entirety according to the invention.

In the drawings like reference characters designate similar parts in the several views of the drawings.

In a preferred embodiment of the invention, the complete unit is shown in FIG. 1 and is indicated by numeral 10.

Figure 7:
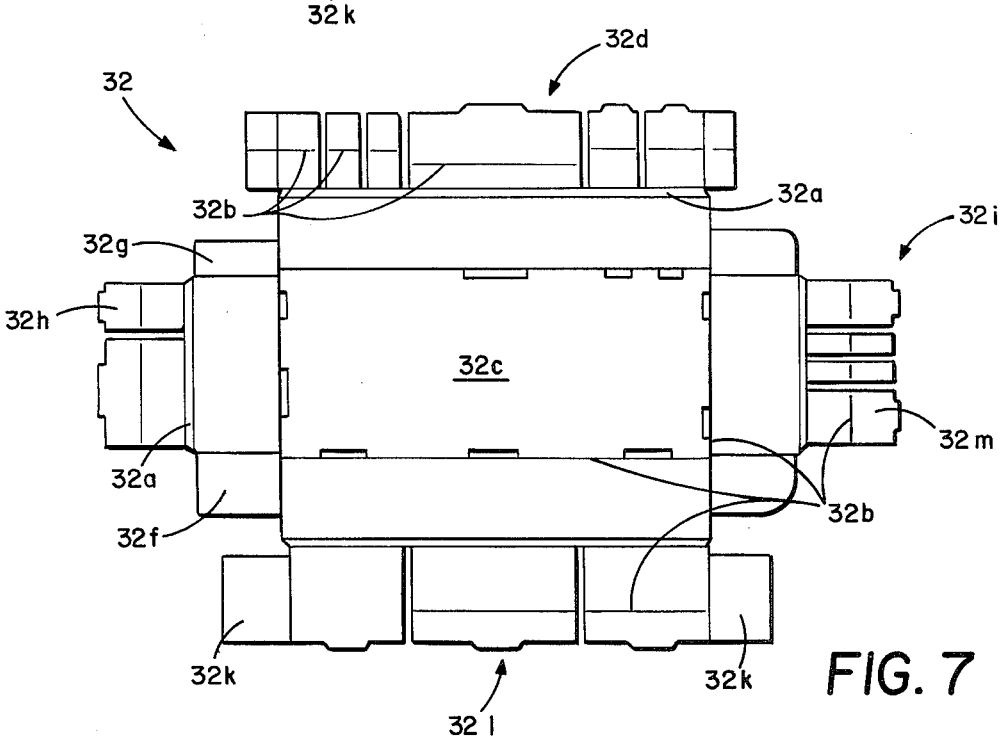
FIG. 7 shows the tray-like section laid out flat prior to placing the partition sub-assembly thereon.

Although the unit 10 may consist of an arbitrary number of components, the preferred embodiment, according to the invention, has a total of 14 parts, including, for example nine partitions 2, 14, 16, 18, 20, 22, 24, 26 and 28 (FIG. 2), three drawers 36 (FIG. 1), one main tray 32 (FIG. 7) and an outer wrap 34 (FIG. 1). The drawers 36 are optional and are made from a foldable flat fiber board section, in a known manner. The main tray 32 could be mounted to and enclose the assembled partitions 12 through 28, in any appropriate way, as long as it will ensure a rigid structure of unit 10. The outer wrap may, likewise be attached to the completed unit 10 in any suitable fashion.

Figure 2:
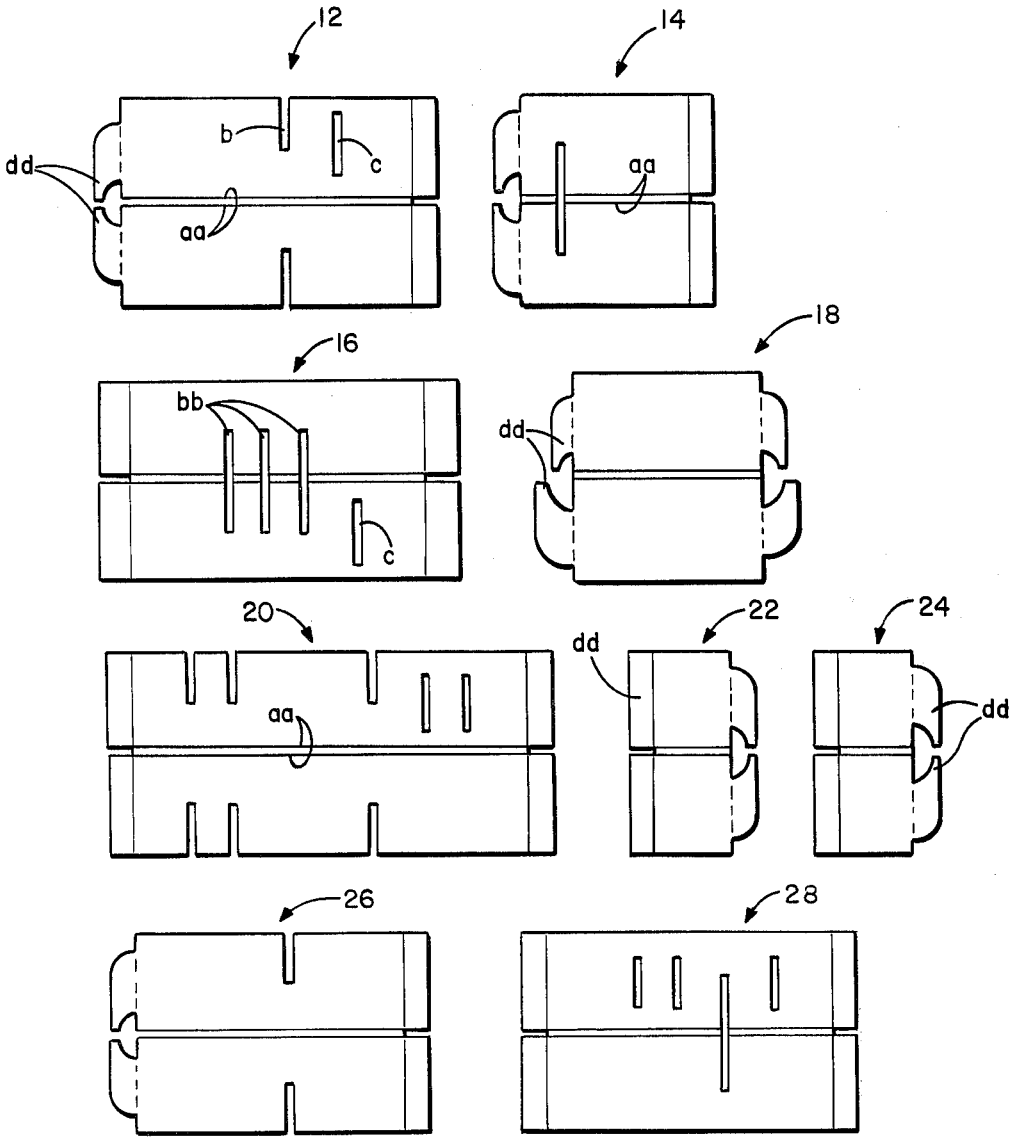
FIG. 2 is a plan view of a number of partitions mountable into a sub-assembly of the desk top organizer.

As it appears from FIG. 2, partitions 12 through 28 are dissimilar in size and shape (except for partitions 22, 24). However, all of the partitions have some features in common. For example, each partition is provided with center double score lines aa, thus 12 aa through 28 aa. The purpose of the score lines is to facilitate the folding of each partition in half along these lines, so as to constitute, in folded state, double walled compartments or pigeon holes when assembled in conjunction with other partitions of unit 10. Each of the nine partitions are folded in a similar manner, as noted, preferably, simultaneously along the double score lines so as to form slightly spaced apart double walls.

Except for partitions 18, 22, 24, each partition (FIG. 2) has at least one die cut slot. For example, partitions 12, 20 and 26 have pairs of aligned first slots b, extending from and through the edges of opposite sides of the partitions towards score lines aa. Partitions 14, 16 and 28 have second slots bb extending, resp. equidistantly from and perpendicularly to the center of the partitions. Partitions 12, 16, 20 and 28 have third slots c, extending within the border lines of the partitions. The slots of a particular partition are labelled, e.g., 12*b*, 12*c*, 16*bb*, as the case may be.

Figure 3:
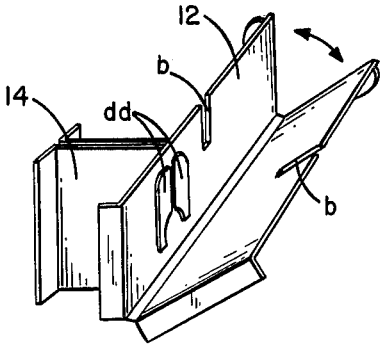
FIG. 3 is a perspective view of two partitions, being assembled.

The short sides of partitions 12 through 28 form die cut pairs of bendable flaps dd, thus the flap extensions (in continuation of score lines aa) of each short side of partitions 12 through 28 are respectively, indicated by numerals 12*dd*–28*dd*. Flap pairs dd of one folded partition are, thus intended to be paired—once the partition is folded along score line aa- and inserted through slot c of another partition, then bent outwardly, to planarly form a rigid gripping connection between two thusly crosswise assembled partitions. FIG. 3 illustrates how this is accomplished in the case of assemblying partitions 12 and 14. When partitions 12, 14 have been so assembled, the double walls of partition 12 are pressed together (as indicated by arrow) and can be temporarily held together by e.g., adhesive tape, until the infrastructure of unit 10 has been completed. The unengaged pairs of flaps dd will be inserted within interior spaces appearing in portions of tray 32 (FIG. 6), when folded.

Some of the flaps dd may have a somewhat rounded or square shape, which may, as required facilitate or strengthen the insertion of the flaps into adjacent partitions and the tray.

Sub-assemblies 16–18, 20–22–24 are basically assembled and mounted in a similar manner, as described above for sub-assembly 12–14.

In other words, sub-assembly 16–18 is assembled by inserting flaps dd of 18 in slot c of 16. Flaps dd of sub-assembly partitions 22–24 are inserted through slots c of partition 20.

As one may visualize from FIG. 3 aligned slots b and bb in partitions 12, 14, 16, 20, 26 and 28 will coincide with one another, when the partitions are folded up along score lines aa.

Figure 4:
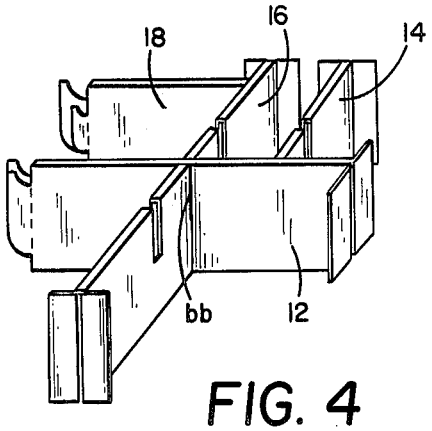
FIG. 4 shows the assembly of four partitions.

The basic functions of slots b and bb are illustrated in FIG. 4. For example, slots b of partition 12 ride in coinciding center slot bb of partition 16 of sub-assembly 16–18, in that slots b of poartitions 12 are slit through center slot **16*bb*** and is supported by the solid portion of the latter (in extention of its slots *bb*).

Thus partition pairs 12–14, 16–18, 20–22–24 are interconnected, as described above.

Folded partition 26 is inserted parallely to partition 12, by having the coinciding slots b of the former slit down through slot bb of partition 16.

Figure 5:
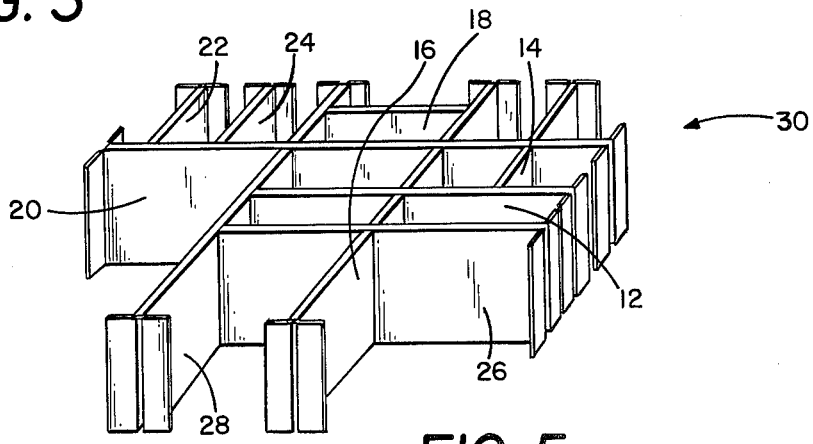
FIG. 5 shows the completed sub-assembly of partitions.

The end flaps dd of the three partitions 12, 18, 26 are, then respectively inserted in the three slots c of partition 28, and sub-assembly 20–22–24 is then inserted in remaining slots of partitions 14, 16 and 28, in order to complete the sub-assembly 30 of partitions 12 through 28 of unit 10. This is shown in FIG. 5.

There is provided means for enclosing the back and four sides of the completed sub-assembly 30. This may, e.g.; take the shape of a tray 32 (FIG. 6) within which sub-assembly 30 may be locked. Tray 32 is provided with double and single foldable score lines, **32*a* and 32*b* respectively, along which tray 32 is folded, so as to receive and enclose top, bottom, back and sides of sub-assembly 30. Tray 32 has a back portion 32*c*, a top portion 32*d* side portions 32*e*, 32*i*, and bottom portion 321, components of which, respectively are, folded, mounted onto and inserted in portions of sub-assembly 30**, forming a compact supportive gripping tray there around, as is explained in more detail hereinafter.

Figure 6:
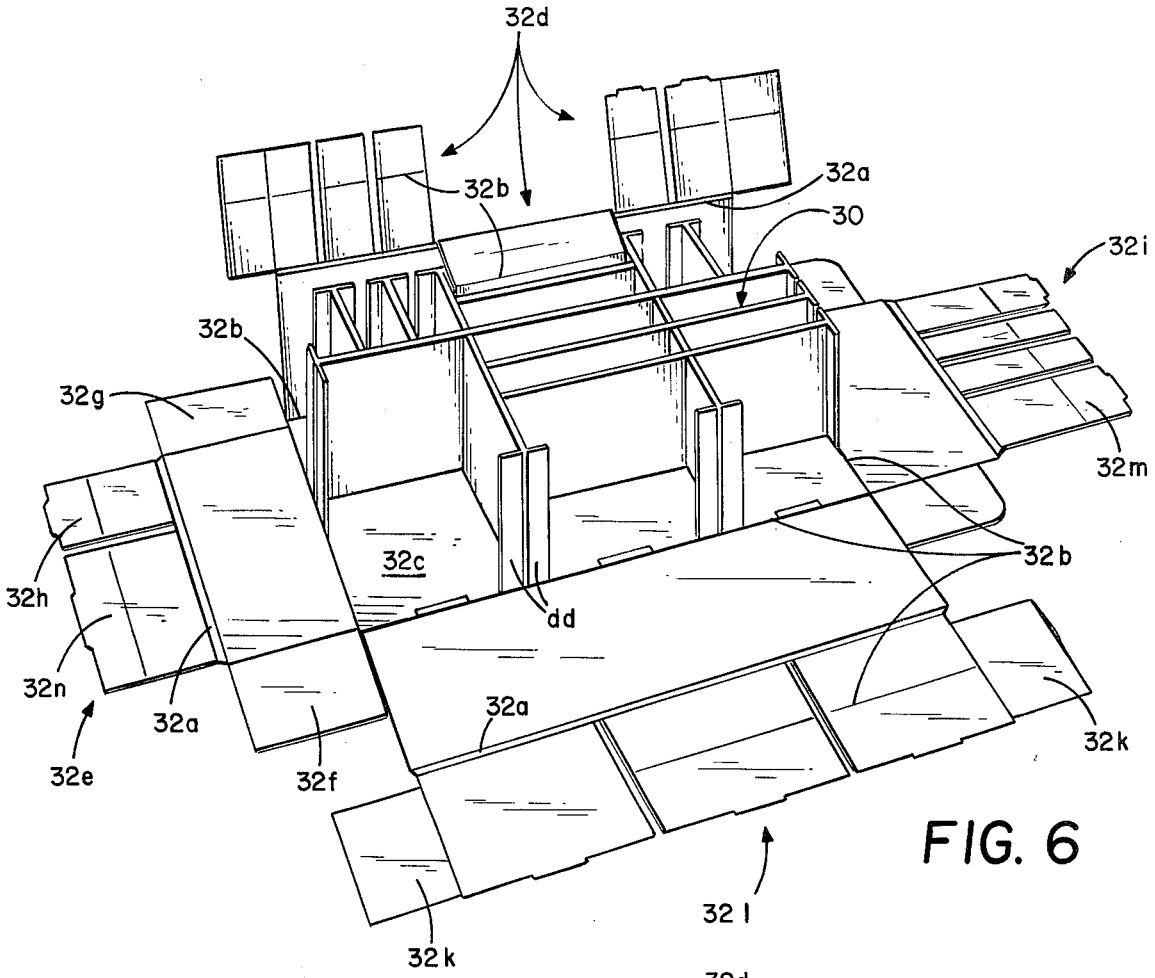
FIG. 6 shows a tray-like section extending in front, behind and laterally of the partition sub-assembly, for mounting thereon.

In order to facilitate the interlocking of sub-assembly 30 and tray 32, one should place tray 32 on a table and prefold first along double score lines **32*a* and then along single score lines 32*b*. Sub-assembly 30 is placed on the center or main tray 32*c* of tray 32. All unengaged flaps dd of sub-assembly 30 are folded at 90° angle to their respective partitions, in order to engage and support the folded-up portions or panels of tray 32 (FIG. 6**).

The middle portion of the top **32*d* of tray 32 is inserted into center section of sub-assembly 30. The side portions of the top 32*d* of tray 32 is then inserted into sub-assembly 30 (FIG. 6). Tabs 32*f*, *g* and ends of side section 32*e* are folded up and tab 32*g* is inserted under adjacent corner panel of top 32*d*. Panel 32*h* of side 32*e* is now inserted into sub-assembly 30. Side section 32*i* (opposite 32*e*) is folded and interconnected with sub-assembly 30 in the same manner as described for side 32*e***.

The panels **32*k* of the bottom portion 321 of tray 32 are then inserted into sub-assembly 30, by folding outer halves of panels 32*k* down at 90° angle to other halves of panels and inserting folded panels, resp., into partition sub-assembly 30. Finally, panel 32*m* of side main tray 32*i* is inserted into sub-assembly 30 and panel 32*h* of side main tray 32*e* is inserted into sub-assembly 30**.

Outer wrap 34 may now be attached to the assembled sub-assembly 30 and tray 32, as shown in FIG. 1.

While the foregoing has illustrated and described what is now contemplated to be the best mode of carrying out the invention, the description is, of course, subject to modifications without departing from the spirit and scope of the invention. Therefore, it is not desired to restrict the invention to the particular constructions illustrated and described, but to cover all modifications that may fall within the scope of the appended claims.

I claim:

1. In a desk top organizing device placeable on a desk top, or the like comprising:

(a) a plurality of sub-assembled partitions, folded in halves along their center lines, respectively and mounted parallely, respectively perpendicularly to one another to form a plurality of double walled compartments;

(b) a tray, foldable for containment of and attachment around the sub-assembly of the partitions, providing bottom, side, top and back supportive surfaces therefor;

(c) an elongated wrap, having a rectangular center portion and two curved lateral portions, the width of which is greater than that of the supportive bottom and side surface of the partition sub-assembly containing tray, around which it is wrapped for attachment thereto, so as to provide forwardly projecting winged sides for and an extension of the bottom supportive surface of the tray.

2. A desk top organizing device, according to claim 1, wherein the device is made of lightweight material.

3. A desk top organizing device, according to claim 1, wherein the device is made of corrugated fiber board.

4. A desk top organizing device, according to claim 1, wherein a number of the partitions, respectively has at least one pair of aligned first slots extending from and through the edges of opposite sides of the partitions towards one another, and a number of the partitions has at least one second slot extending equidistantly from and perpendicularly to the center thereof, so that the first and second slots, respectively constitute coinciding doubled-up slots within the folded partitions, the first coinciding slots of one partition, respectively being inserted within the coinciding second slots of another partition and riding in alignment therewith on and perpendicularly to the unslotted portion of the said other partition.

5. A desk top organizing device, according to claim 4, wherein the ends of the partitions constitute pairs of flaps, respectively, and a number of the partitions, respectively is provided with third slots, extending within the edges of one half thereof, so that paired flaps of one partition when folded, will double up, for insertion through one of the third slots of another partition to engage and form a rigid connection therewith when the flaps are separated and planarly pressed against the inner surface of such other partition, the unengaged pairs of flaps of the partitions being, respectively attached within interior spaces appearing in the tray when folded together to form the supportive surfaces of the sub-assembly of the device.

* * * * *